US008523742B2

(12) United States Patent
Lam et al.

(10) Patent No.: US 8,523,742 B2
(45) Date of Patent: Sep. 3, 2013

(54) BABY WALKER

(75) Inventors: Peter Ar-Fu Lam, Hsinchu (TW); Chun-Ting Lee, Taipei (TW); Ting-Ku Tao, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 295 days.

(21) Appl. No.: 12/873,324

(22) Filed: Sep. 1, 2010

(65) Prior Publication Data

US 2012/0053022 A1 Mar. 1, 2012

(51) Int. Cl.
*A47D 13/04* (2006.01)

(52) U.S. Cl.
USPC ..... 482/66; 482/69; 280/87.051

(58) Field of Classification Search
USPC ..... 482/66.69; 280/87.051
See application file for complete search history.

(56) References Cited

U.S. PATENT DOCUMENTS

| | | | | |
|---|---|---|---|---|
| 2,657,735 | A | 11/1953 | Hughes | |
| 3,515,404 | A | 6/1970 | Perego | |
| 3,796,430 | A | 3/1974 | Sudo | |
| 4,773,639 | A * | 9/1988 | Graves | 482/66 |
| D340,210 | S | 10/1993 | Veness | |
| 5,732,961 | A * | 3/1998 | Theodoropoulos | 280/87.051 |
| 7,017,924 | B1 | 3/2006 | Lambert | |
| 2004/0002407 | A1 * | 1/2004 | Hawkes et al. | 482/69 |
| 2004/0045073 | A1 | 3/2004 | Marquez et al. | |

FOREIGN PATENT DOCUMENTS

| | | |
|---|---|---|
| TW | 146989 | 12/1990 |
| TW | 173160 | 11/1991 |

* cited by examiner

*Primary Examiner* — Glenn Richman
(74) *Attorney, Agent, or Firm* — Jianq Chyun IP Office

(57) ABSTRACT

A baby walker is introduced herein. The baby walker includes a base and a pair of shoulder straps. The base is made by flexible materials such as plastics, or the similar materials. In one exemplary embodiment, the base of the baby walker may be packaged in a deflated form, and may be filled with air to form a shape as desired for an operation mode. The baby walker further includes a pair of shoulder straps which are firmly and fixedly attached in a peripheral upper side of the base. When the baby is placed in a central cavity of the base, the pair of the shoulder straps can be placed alongside the two shoulders of the baby. When the baby wears the baby walker and stands up, the whole baby walker is lifted up for a height above the ground level.

29 Claims, 7 Drawing Sheets

BABY WALKER

BACKGROUND

1. Technical Field

The present disclosure relates to a baby walker.

2. Description of Related Art

A baby or an infant begins to stand up and learn to walk when he/she grows to about 10~12 months. During that time, a parent usually buys a baby walker for the baby or infant to practice walking. Traditional baby walkers come with wheels located at the bottom of the walker for the baby to ride in its seat padding and to move freely with the wheels of the walker accompanying the moving force of the baby's own two legs.

There are different types of baby walkers, some of which have annular or ring-type bases. It is difficult to store the baby walkers because the diameter of the ring-type base and the three dimensional structure of the baby walker are fairly large. Thus, the parents must provide a significant room for storing the traditional baby walker. Some baby walkers, currently available in the market, are foldable so as to facilitate carrying and enable storage in areas of restricted space. However, the baby walkers often include complex release mechanisms which must be manipulated to move the walkers into a folded position. In many cases, for reasons of safety, the release mechanisms are intentionally made difficult to operate to prevent the accidental or improper collapse of the baby walker by a child seated therein.

SUMMARY

Accordingly, the disclosure is directed to a baby walker defined to be a protective structure that helps a baby learn or practice walking without the help or involvement of an adult. In contrast to a traditional baby walker that provides a supportive structure for a baby to lean on the supporting structure to practice walking, a primary objective of the subject disclosure is to provide a light weight protective baby walker that allows a baby to practice walking freely without any external support.

In order to make the aforementioned and other features of the present disclosure more comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate exemplary embodiments and, together with the description, serve to explain the principles of the disclosure.

DESCRIPTION OF DISCLOSED EMBODIMENTS

Figure 1A:
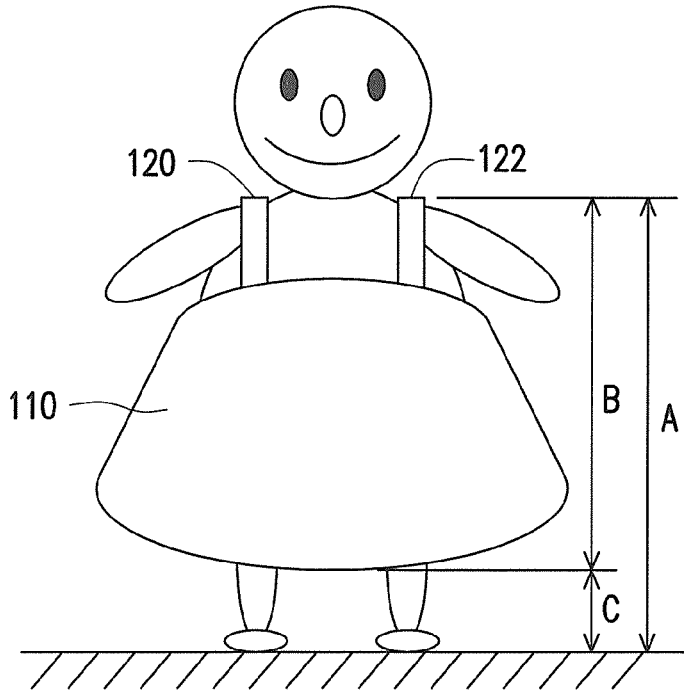
FIGS. 1A and 1B are schematic views of a baby walker in one exemplary embodiment of the disclosure.

A need remains for a foldable baby walker. Embodiments disclosed herein may provide a foldable baby walker that can be inflated. The baby walker has a substantial structure made by flexible materials such as rubber, plastics, or other materials with similar properties. In one exemplary embodiment, the substantial structure of the baby walker may be packaged in a deflated form to reduce the size of the packing for transportation and retail. The substantial structure of the baby walker may be folded to further reduce the size of packaging. Before the baby walker is being used, the substantial structure of the baby walker may be filled with air by using an air pump, an air compressor, or blown up by the parent, to form a shape as desired.

The substantial structure of the inflated baby walker is structured and dimensioned to maintain the center of gravity of the baby within the foot print of the baby walker when the baby falls during walking practice. Foot print of a baby walker embodiment herein is defined by the contact area of the base and the ground when the base is rested on the ground. As compared with traditional baby walkers, the air inflated structure for a baby walker provides at least several advantages. First, it provides a compact size for storage or retail, which reduces transportation cost for retail channels as well as reducing the shelve space required in retail stores. The compact size storage mode also facilitates user families to carry around the walker with the baby. Another advantage of the air inflated walker is that the air cushion of the baby walker practically reduces the degree of damage when a baby rides the walker and hits a piece of furniture. The air inflated baby walker also provides a soft cushion when the baby falls. In a close observation of how a baby walks with a traditional walker, it is found that babies actually tend to lean on the mechanical walker to obtain walking balance. It means the baby does not really practice free walking independently. In one exemplary embodiment, one more significant advantage of the air inflated baby walker as compared with traditional walkers is the significantly reduced weight that allows the baby to completely lift up the baby walker and practice walking freely.

In an exemplary embodiment of the baby walker disclosed herein, the baby walker includes a pair of shoulder straps. When the baby is placed in a central cavity of the baby walker, the pair of the shoulder straps can be placed alongside the two shoulders of the baby. The extension of the shoulder straps are dimensioned according to the typical height of the baby, in a way that when the baby wears the baby walker and stands up, the whole baby walker is lifted up for a reasonable height from the ground allowing the baby to practice walking freely without any support from the adult.

In a further embodiment of the light weight baby walker, it is provided a substantial structure made with flexible materials such as plastics or fabric, or the similar materials. In one exemplary embodiment, the substantial structure of the baby walker may be packaged in a deflated storage mode for shipping, for retailing in the store or for storing in the home of the end user; and may be filled with air to provide an inflated operation mode for use by the baby. Instead of wheels that add cost and weight to the baby walker, light weight protective pads are provided at the bottom of the baby walker to protect the baby walker from damages caused by excessive rubbing between the bottom of the inflated baby walker with the floor.

In one exemplary embodiment, the substantial structure is a base having a central cavity in the center arranged for the baby to be placed therein the base. A pair of shoulder straps is firmly and fixedly attached in a peripheral upper side of the base. One end of the shoulder strap is fixedly attached to a front part of the peripheral upper side of the base, and the other end is also fixedly attached to a back part of the peripheral upper side of the base. The two shoulder straps are arranged to be separated from each other by a certain distance apart, which depends on the width between the two shoulders of a typical baby, who uses the walker. In an alternate embodiment, the central parts of the two shoulder straps may intersect each other. When the baby is placed in the central cavity of the base, the pair of shoulder straps can be placed alongside the two shoulders of the baby.

In one further exemplary embodiment, the lengths of the shoulder straps are particularly designed and adjustable to fit the height of the baby wearing the baby walker, such that the bottom of the baby walker is lifted from the floor when the baby practices walking. Accordingly, the amount of extension of the adjustable shoulder straps is determined by the typical body height of a baby during the walking period. For example, this extension is designed to work for body height of a baby between 9 months to 15 months old, which is easily achieved by using a fastener or buckle to adjust the length of the shoulder strap. When the baby is placed in the central cavity of the base and the two shoulder straps are placed alongside the two shoulders of the baby, the whole light weight baby walker may be lifted up for a height from the bottom side of the base to the ground when the baby stands up. In one embodiment, the height from the bottom side of the base to the ground may be 10 to 30 centimeters (cm).

A baby learning to walk usually fails to control the walking speed and may easily get hurt when fallen. One problem found in the subject disclosure process of a baby walker without wheels is that the baby walker tends to easily tip over when the baby runs on the baby walker at high speeds and when the frictional force between the bottom of the baby walker and the floor is excessive. Accordingly, the baby walker is carefully designed to prevent the baby walker from tipping over. Dimensions and shapes of the baby walker are found to be critical to achieve this goal. A solution found is to dimension and shape the baby walker such that when the walker is suddenly stopped while a baby wearing the baby walker is running, the center of gravity of the baby and walker combination is always maintained within the foot print of the baby walker.

In one embodiment, the height of the bottom of the walker above the ground is related to the size of the foot print of the walker. If the dimension is not carefully controlled, the baby and the walker combination may tip over when the baby runs and falls during walking practice. Therefore, the shoulder straps are accordingly designed to be adjustably extended or shortened, as desired. For example, it is dimensioned such that the center of gravity of the combination of the baby and walker always stays within the base of the walker under all conditions of application. Adjustable shoulder straps are therefore provided to adjust and maintain a proper level between the base of the walker and the ground level when the baby stands up.

In one exemplary embodiment, a seat pad, which may be made by soft materials, is firmly attached to a circumference of an upper inside portion of the base. The seat pad is resiliently suspended from the upper inside portion of the base. The seat pad has two openings for the baby to place his/her legs therein.

In one exemplary embodiment, the base may be further supported by a plurality of circumferentially spaced wheels, which are firmly attached to a circumference of a lower portion of the base. These wheels may be factory installed onto the deflated, foldable base, or user installed.

In one exemplary embodiment, the baby walker may be packaged in one box for sale. A plurality of accessories is co-packaged for sale. For example, a simple air pump may be included as an accessory of the retail package for inflating the base.

The design in the disclosure satisfies such a need by providing a baby walker that is easy and comfortable to use, miniature, portable and foldable in design to reduce storage and retail space, and durable in construction. The air cushion of the baby walker protects both the baby and the furniture nearby when a baby practices walking, conveniently allowing a parent to feel relaxed as they take care of the baby.

Figure 1B:
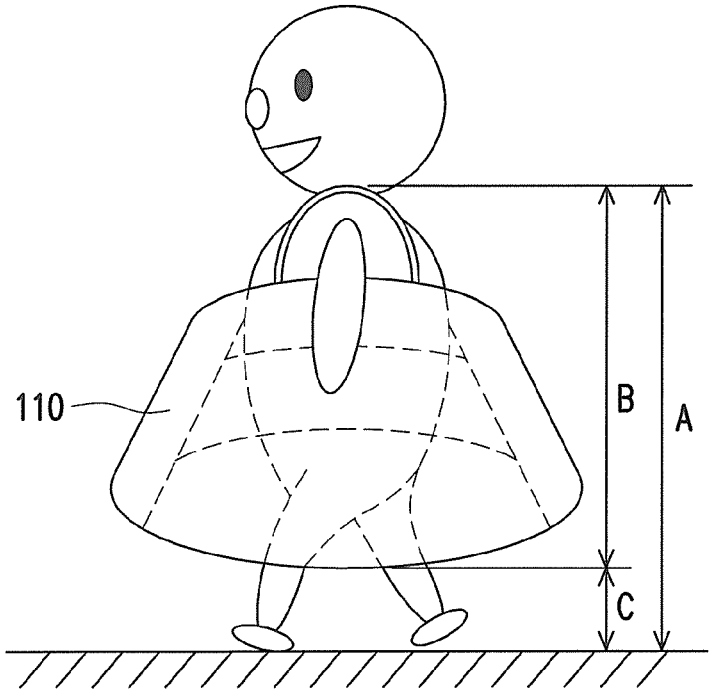

Please refer to FIGS. 1A and 1B, which depict a baby walker in one exemplary embodiment of the disclosure. The baby walker includes a base 110 and two shoulder straps 120 and 122. The baby walker can be inflated by blowing into the air intake of the base 110. The base 110 may be made by flexible materials such as rubbers or plastics or other similar materials. The base 110 can be packaged into a small retail box when it is in a substantial flat deflated and folded form, and may be filled with air by using an air pump, an air compressor, or blown up by the parent, to form a shape as designed.

The base 110 has a central cavity in the center arranged for the baby to be placed therein. The shoulder straps 120 and 122 are firmly and fixedly attached to two opposite sides of a peripheral upper portion of the base 110. One end of the shoulder strap 120 or 122 is fixedly attached to a front part of the peripheral upper side of the base, and the other end is also fixedly attached to a back part of the peripheral upper side of the base.

The two shoulder straps 120 and 122 are arranged to be separated from each other by a certain distance apart, which depends on the width between the two shoulders of the baby who uses the walker. When the baby is placed in the central cavity of the base 110, the shoulder straps 120 and 122 can be placed alongside the two shoulders of the baby. The lengths of the shoulder straps 120 and 122 are adjustable to fit the height of the baby. When the baby is placed in the central cavity of the base 110 and the two shoulder straps 120 and 122 are placed alongside two shoulders of the baby, the whole baby walker may be lifted up to a height from the bottom side of the base 110 to the ground when the baby stands up.

As shown, the height from the shoulders of the baby to the ground is referenced as "A." The height from the shoulders of the baby to the bottom side of the base 110 is referenced as "B", and the height from the bottom side of the base to the ground when the baby stands up is referenced as "C." In one embodiment, the height "A" is designed to be in a range from 50 to 60 centimeters (cm), the height "B" is designed to be in a range from 35 to 50 cm, and the height "C" is designed to be in a range from 5 to 30 centimeters (cm), and for example, in a range from 10 to 20 cm. As shown in FIG. 1B, because the whole light weight baby walker is lifted up to the height "C" from the bottom side of the base 110 to the ground when the baby stands up, the baby is free to learn walking around.

Figure 2A:
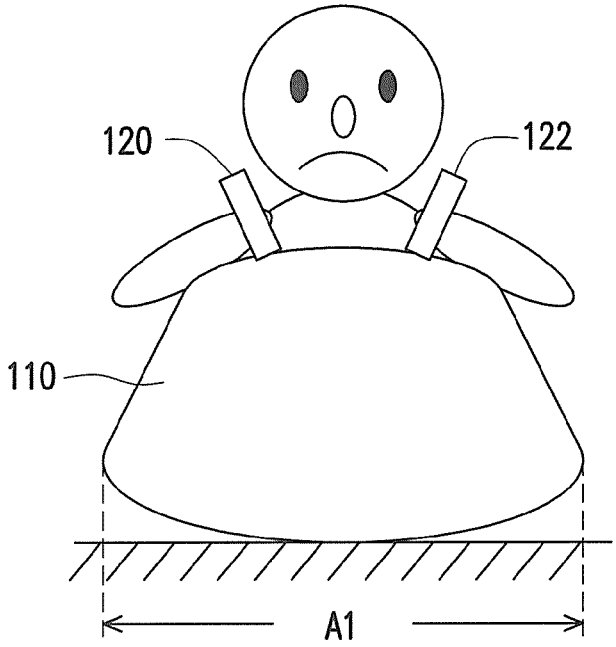
FIGS. 2A and 2B are schematic views of how the baby is protected from falling when using the embodiment of FIGS. 1A and 1B.
Figure 2B:
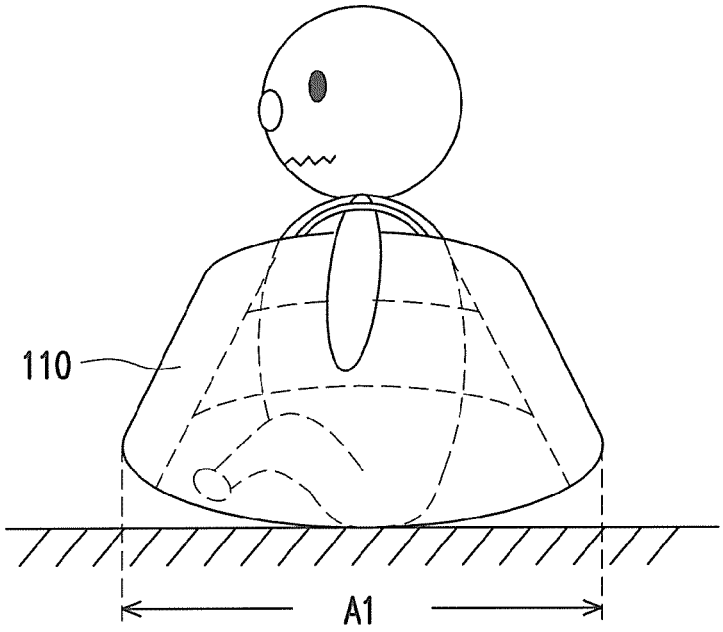

Please refer to FIG. 2A and FIG. 2B, when the baby falls or feels tired, because the thickness of the structure of the base 110 is small, and the base 110 is filled with air, the baby can directly rest onto the cushioned baby walker which the bottom of the baby walker rests on the floor. The base 110 changes shape to absorb the pressure of the baby when he/she sits down or falls. Because the center of gravity of the baby and walker combination is designed to always fall within the periphery of the foot print of the baby walker, tip over never happens when the baby falls during walking practice. In one embodiment, the foot print of a baby walker is defined by the vertically projected area of the base towards the ground when the base is rested on the ground, for example, the area "A1" as shown in FIG. 2A and FIG. 2B. It should be noted that the foot print of the invented baby walker includes the possible contact area of the bottom surface of the base and the ground when the base is rested on the ground.

Figure 3:
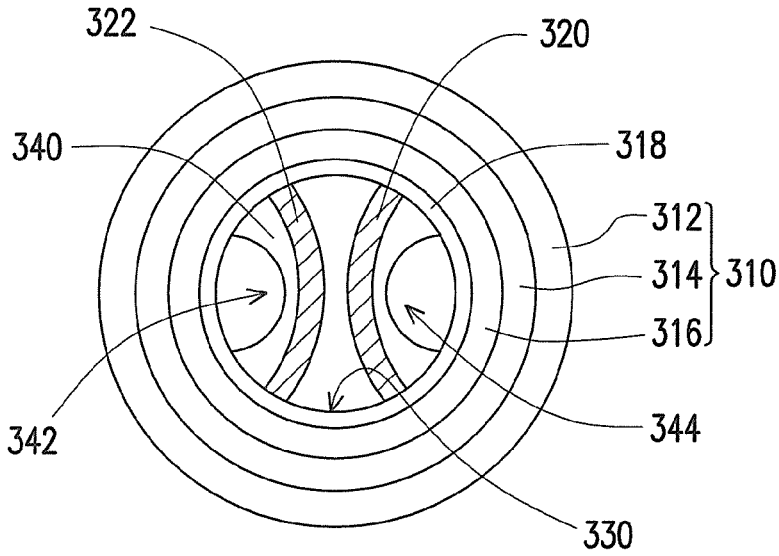
FIG. 3 is a schematic top view of a baby walker in another exemplary embodiment of the disclosure.

Please refer to FIG. 3, which depicts a baby walker in another exemplary embodiment of the disclosure. The baby walker includes a base 310 and two shoulder straps 320 and 322. Instead of a single integral base structure, the base 310 may include three ring-type cylinders 312, 314 and 316 stacked and attached together. In the embodiment, a seat pad 340 with ductility is firmly attached to a circumference 318 of an upper inside portion of the ring-type cylinder 312 of the base 310. The seat pad 340 may be made by soft materials. The seat pad 340 has two openings 342 and 344 for the baby to place his/her legs therein. The seat pad 340 is resiliently suspended from the upper inside portion of the ring-type cylinder 312 of the base 310.

Figure 4:
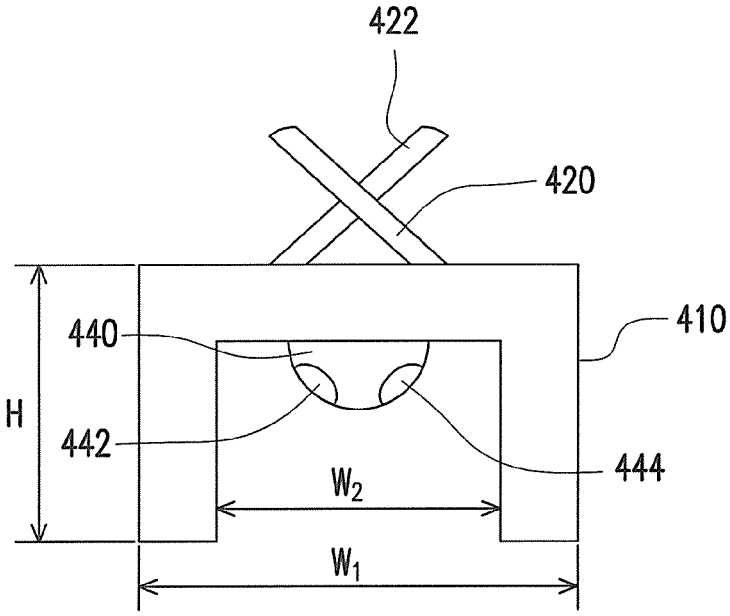
FIG. 4 is a schematic section view of a baby walker in another exemplary embodiment of the disclosure.

Please refer to FIG. 4, which depicts a baby walker in a further exemplary embodiment of the disclosure. The baby walker includes a cylindrical base 410 and two shoulder straps 420 and 422. The base 410 has a central cavity in the center arranged for the baby to be placed therein. A seat pad 440 with ductility is firmly attached to an upper inside portion of the base 410. The seat pad 440 has two openings 442 and 444 for the baby to place his/her legs therein. The base 410 has a concave space for the legs of the baby to move freely, and the width of the concave space is W2, which is smaller than the width W1 of the base 410. The center of gravity when the baby is wearing the baby walker is located in an area within the coverage of the base 410 projected to the ground. The vertical level of the center of gravity above the ground level during application is defined as H1. The extension of H1 and W1 are carefully determined with the highest walking speed of babies such that it will never allow the whole system to tip over and cause the baby to fall to the ground.

Figure 5A:
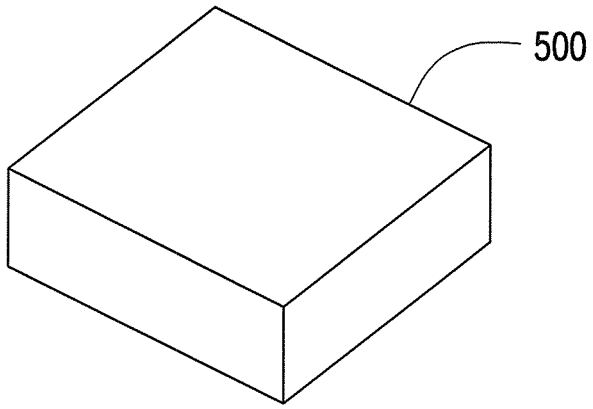
FIG. 5A~5F depicts a method of using a baby walker in an exemplary embodiment of the disclosure.
Figure 5B:
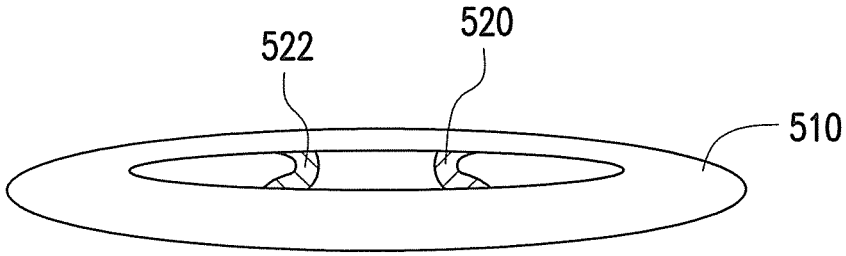
Figure 5C:
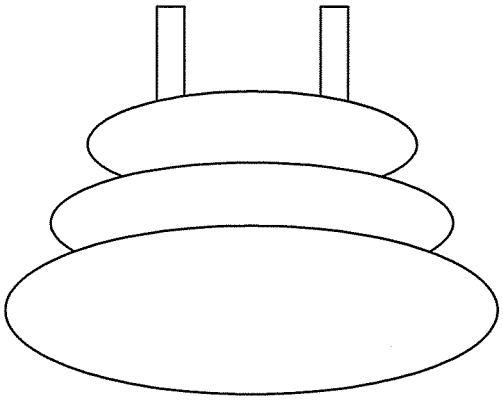
Figure 5D:
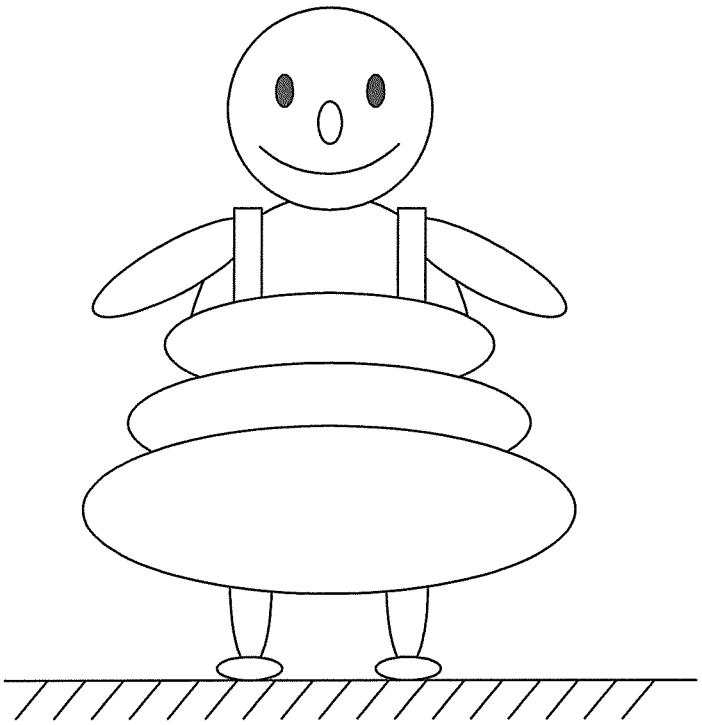
Figure 5E:
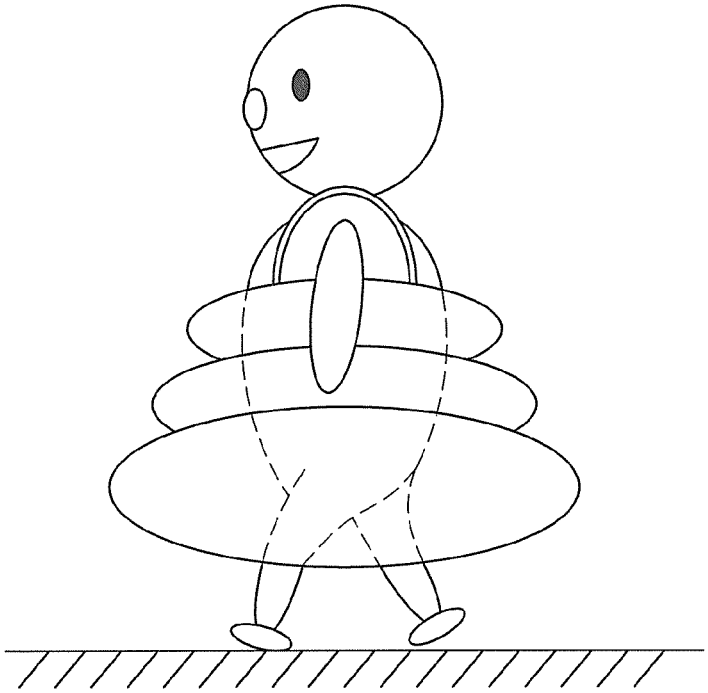
Figure 5F:
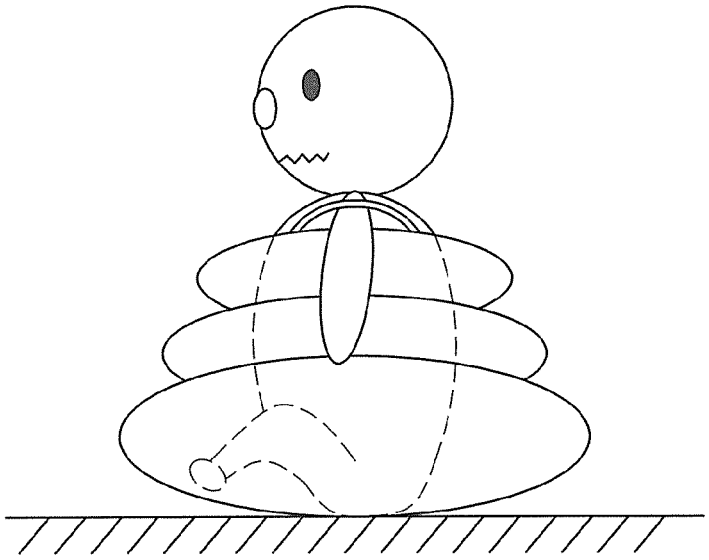

Please refer to FIG. 5A~5F, which depicts a method of using a baby walker in an exemplary embodiment of the disclosure. As in FIG. 5A, the baby walker is packaged in one box 500 for sale. A plurality of accessories is co-packaged for sale. The baby walker includes a base 510 and two shoulder straps 520 and 522. As shown in FIG. 5B, the base 510 is packaged to be a substantial flat deflated form for defining a storage mode or retail mode. The deflated flat sheet walker may be folded to further reduce the size of the storage mode or retail mode that fits the retail packaging of FIG. 5A. In the field, the baby walker may be filled with air by using an air pump, an air compressor, or blown up by the parent, to form a shape as designed to define an application mode or operation mode as shown in FIG. 5C. In the embodiments of FIG. 5A to FIG. 5F, the baby walker is formed by two or more air inflated rings stacked on top of each other. As shown in FIG. 5D, the baby can wear the baby walker and lift up the baby walker above the ground level. FIG. 5E illustrates how the baby can practice walking freely with the invented baby walker. In FIG. 5F, when the baby feels tired or falls, the air cushion of the base safely protects the baby from being hurt.

Figure 6A:
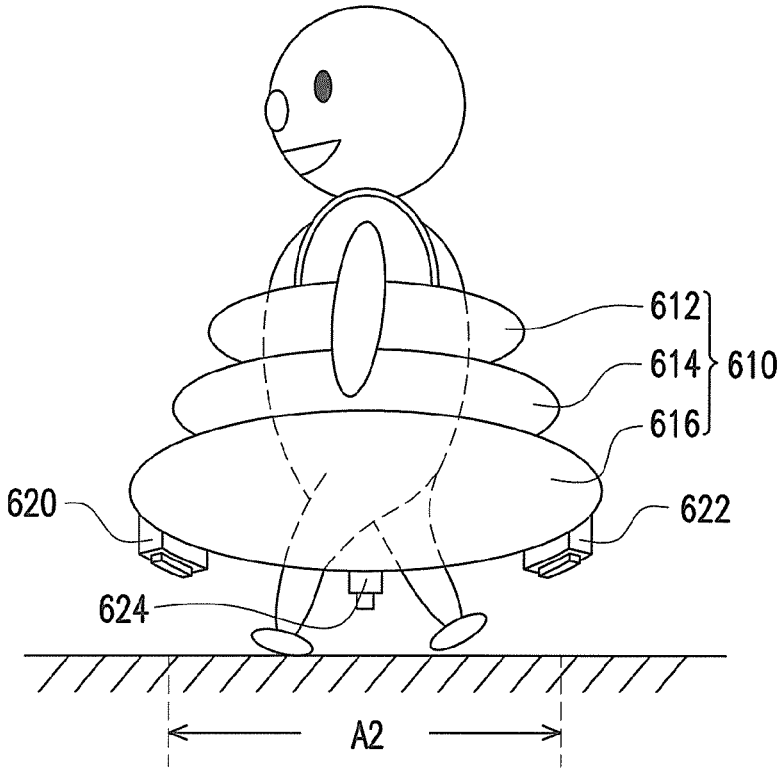
FIGS. 6A and 6B are a schematic view and a bottom view of a baby walker in another exemplary embodiment of the disclosure, respectively.
Figure 6B:
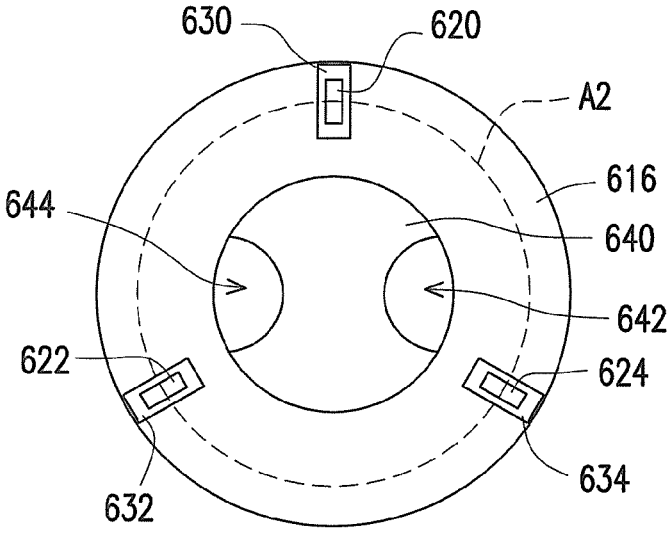

In one exemplary embodiment, as shown in FIGS. 6A and 6B, a plurality of circumferentially-spaced protective pads 620, 622 and 624 can be installed in the baby walker for protecting the base from being damaged when excessively rubbed with the ground. The alternate base 610 may include three ring-type cylinders 612, 614 and 616 stacked and adhered together. In one embodiment, a seat pad 340 with ductility is firmly attached to a circumference of an upper inside portion of the ring-type cylinder 612 of the base 610. The seat pad 640 may be made by soft materials. The seat pad 640 has two openings 642 and 644 for the baby to place his/her legs therein. In the embodiment, one or more protective pads 620, 622 and 624 are respectively attached thereto, as shown in FIG. 6B. In this embodiment, three circumferentially-spaced protective pads 620, 622 and 624 are symmetrically arranged around the circumference of a lower outside portion of the base 610. Protective pads may be formed by plastic pads or durable fabric materials which are glued or adhered to the base. For a further optional design, the base 610 is supported by the caster wheels in the same position of 620, 622 and 624 instead of protective pads in a balancing manner. In this optional embodiment, the inflated walker function works like a traditional baby walker.

The above exemplary embodiments are provided for demonstrating the design principles of the subject disclosure. Various further modifications are possible to be applied to the design of the embodiments. In an exemplary alternation, the shape of the circular base can be changed into a square/rectangular base; different shapes of the shoulder straps are also possible. In a further alternation, the multiple cylinders may be interconnected so that it can be air filled with only one inlet. Alternately, wheels instead of the protective pads of FIGS. 6A and 6B can be attached to a metallic, wood or molded base, and then further attached to the inflatable base 110 of FIG. 1A as an accessory part of the retail package, or an upgrade component of the standard package of FIG. 1A. In this situation, the foot print of the walker is defined by the periphery line connecting adjacent pairs of wheels. In a further modification, the shoulder straps may be replaced by frictional fit of the baby body with the inner diameter of the base. Further modifications may be required for the material and structures of the subject disclosure to comply with traditional safety requirements for baby products. All these alternations are included in the scope of the subject disclosure.

Although the disclosure has been described with reference to the above exemplary embodiments, it will be apparent to one of the ordinary skill in the art that modifications to the described exemplary embodiment may be made without departing from the spirit of the disclosure. Accordingly, the scope of the disclosure will be defined by the attached claims not by the above detailed descriptions.

What is claimed is:

1. A baby walker, comprising a substantial structure made with flexible materials, wherein the substantial structure has a base near the ground, when a baby wears the baby walker, said baby walker is configured for the base of the substantial structure being lifted from a ground level when the baby is in a standing up or walking position without the support of an adult, and said baby walker is further configured for the base of the substantial structure to rest on the ground level when the baby is not in said standing up or walking position.

2. A baby walker as claimed in claim 1, further comprising:

an adjustable structure attached to the substantial structure, wherein the adjustable structure is configured to lift up the baby walker above the ground, when the baby is in a standing up or walking position without the support of an adult.

3. A baby walker as claimed in claim 1 further comprises a pair of shoulder straps disposed alongside the shoulders of the baby for lifting up the baby walker above the ground when the baby is in a stand up or walking practice position.

4. A baby walker as claimed in claim 3, wherein the lengths of the pair of shoulder straps are adjustable to fit the height of the baby wearing the baby walker, thereby the baby walker is lifted up above the ground when the baby stands up or practices walking.

5. A baby walker as claimed in claim 1, wherein the substantial structure is air inflated during an operation mode, and is deflated during a storage mode or a retail mode.

6. A baby walker as claimed in claim 1, wherein the substantial structure is deflated and folded to provide a compact size for a storage mode or a retail mode.

7. A baby walker as claimed in claim 1, wherein a dimension of the substantial structure used during the operation mode is sufficient enough for the baby walker to be lifted up above the ground 5 cm to 20 cm when the baby stands up or practices walking.

8. A baby walker as claimed in claim 1, wherein the dimension of the substantial structure used during the operation mode is sufficient enough to maintain the center of gravity of the baby within a foot print of the base of the baby walker when the baby falls during walking practice.

9. A baby walker as claimed in claim 1, further comprising protective pads located at the bottom of said substantial structure for protecting said substantial structure from rubbing with the ground.

10. A baby walker, comprising a substantial structure and shoulder straps attached to the substantial structure, wherein the shoulder straps are structured for a baby to lift up the walker above the ground; wherein the substantial structure is lifted from a ground level when the baby stands up or practices walking without the support of an adult.

11. A baby walker as claimed in claim 10, wherein the lengths of the pair of shoulder straps are adjustable to fit the height of the baby wearing the walker, thereby enabling the walker to be lifted up above the ground when the baby stands up or practices walking.

12. A baby walker as claimed in claim 10, wherein the substantial structure is air inflated during an operation mode, and is deflated during a storage mode.

13. A baby walker as claimed in claim 10, wherein the substantial structure and shoulder straps are dimensioned for the baby walker being lifted up above the ground 5 cm to 20 cm when the baby stands up or practices walking during an operation mode.

14. A baby walker as claimed in claim 10, wherein the substantial structure used during the operation mode is dimensioned to maintain the center of gravity of the baby within a foot print of the baby walker when the baby falls during walking practice.

15. A baby walker as claimed in claim 10, further comprising protective pads located at the bottom of said substantial structure for protecting said substantial structure from rubbing with the ground.

16. A baby walker, comprising a substantial structure made with flexible materials, wherein the substantial structure has an air inflated property, in which the substantial structure is filled with air to be inflated for use by a baby in an inflated operation mode, and is deflated for a storage mode, wherein the substantial structure is structured and dimensioned to maintain the center of gravity of the baby within a foot print of the baby walker when the baby falls during walking practice; and a wearing structure, attached to the substantial structure, wherein when the baby stands up or practices walking without the support of an adult, the wearing structure lifts up the baby walker above the ground.

17. A baby walker as claimed in claim 16, wherein the wearing structure comprises a pair of shoulder straps, when the baby stands up, the pair of shoulder straps is disposed alongside the shoulders of the baby to lift up the baby walker above the ground.

18. A baby walker as claimed in claim 17, wherein lengths of the pair of shoulder straps are extensible to be adjusted to fit the height of the baby wearing the baby walker, whereby the baby walker is lifted up above the ground when the baby stands up or practices walking.

19. A baby walker as claimed in claim 16, wherein the dimension of the substantial structure used in the inflated storage mode is sufficient enough for the baby walker to be lifted up above the ground 5 cm to 20 cm when the baby stands up or practices walking without the support of an adult.

20. A baby walker as claimed in claim 16, wherein the dimensions of the substantial structure used in the inflated storage mode is sufficient enough to maintain the center of gravity of the baby within a foot print of the baby walker when the baby falls during walking practice.

21. A baby walker as claimed in claim 16, further comprising protective pads located at the bottom of said substantial structure for protecting said substantial structure from rubbing with the ground.

22. A method of providing a baby walker, comprising the steps of:

packaging the substantial structure of the baby walker in a substantial flat deflated form for defining a storage mode; and filing the substantial structure of the baby walker with air to form a shape for use by a baby in an inflated operation mode, wherein said baby walker is structured for the baby to lift up the baby walker above the ground when the baby stands up or practices walking without the support of an adult.

23. A method as claimed in claim 22, wherein said baby walker is structured and dimensioned to maintain the center of gravity of the baby within a foot print of the baby walker when the baby falls during walking practice.

24. A method as claimed in claim 22, wherein said baby walker is further provided with a mounting structure attached to the substantial structure of the baby walker for mounting alongside the shoulders of the baby, said mounting structure is structured to provide a counterforce act against the shoulders of the baby for lifting up the baby walker above the ground when the baby stands up or practices walking.

25. A method as claimed in claim 22 wherein said baby walker is further provided with protective pads located at the bottom of said substantial structure for protecting said substantial structure from rubbing with the ground.

26. A method of providing a baby walker as claimed in claim 1, the method comprising:

packaging the substantial structure of the baby walker in a substantial flat deflated form for defining a storage mode; and filling the substantial structure of the baby walker with air to form a shape for use by a baby in an inflated operation mode, wherein said baby walker is structured for the baby to lift up the baby walker above the ground when the baby stands up or practices walking without the support of an adult.

27. A method as claimed in claim 26, wherein said baby walker is structured and dimensioned to maintain the center of gravity of the baby within a foot print of the baby walker when the baby falls during walking practice.

28. A method as claimed in claim 26, wherein said baby walker is further provided with a mounting structure attached to the substantial structure of the baby walker for mounting alongside the shoulders of the baby, said mounting structure is structured to provide a counterforce act against the shoulders of the baby for lifting up the baby walker above the ground when the baby stands up or practices walking.

29. A method as claimed in claim 26, wherein said baby walker is further provided with protective pads located at the bottom of said substantial structure for protecting said substantial structure from rubbing with the ground.

* * * * *